United States Patent [19]

Peacock

[11] Patent Number: 4,869,036

[45] Date of Patent: Sep. 26, 1989

[54] MODULAR BUILDING CONSTRUCTION

[75] Inventor: Charles M. Peacock, Midhurst, Canada

[73] Assignee: Building With Legs, Ltd., Canada

[21] Appl. No.: 26,279

[22] Filed: Mar. 16, 1987

[51] Int. Cl.[4] ..... E04B 1/00

[52] U.S. Cl. ..... 52/233; 52/79.1; 52/90; 52/282; 52/474

[58] Field of Search ..... 52/79.1, 79.2, 79.9, 52/79.12, 238.1, 239–243, 243.1, 233, 404, 407, 474, 280–284, 169.14, 90

[56] References Cited

U.S. PATENT DOCUMENTS

| | | | |
|---|---|---|---|
| 1,277,766 | 9/1918 | Stadelman | 52/90 |
| 1,297,379 | 3/1919 | MacDonald | 52/90 X |
| 1,673,788 | 6/1928 | Hobson | 52/90 |
| 4,320,610 | 3/1982 | Rupp | 52/233 |
| 4,364,987 | 12/1982 | Goodwin | 428/192 |
| 4,373,313 | 2/1983 | Nash, Jr. | 52/397 |
| 4,567,701 | 2/1986 | Biggs et al. | 52/233 |

FOREIGN PATENT DOCUMENTS

| | | | |
|---|---|---|---|
| 1027329 | 3/1978 | Canada | 52/233 |
| 2516157 | 5/1983 | France | 52/474 |
| 1096348 | 6/1984 | U.S.S.R. | 52/474 |
| 2024911A | 1/1980 | United Kingdom | 52/474 |
| 2057529A | 4/1981 | United Kingdom | 52/281 |

*Primary Examiner*—David A. Scherbel
*Assistant Examiner*—Richard E. Chilcot, Jr.
*Attorney, Agent, or Firm*—Ostrolenk, Faber, Gerb & Soffen

[57] ABSTRACT

A modular building concept is described which entails connection of a building module between building support columns. The module comprises a frame having two uprights for connection to opposed faces of adjacent columns and a panel connected to the uprights. In a specific embodiment, the panel is formed by planks stacked vertically on their edges to reproduce the pièce en pièce appearance in which the columns are exposed on the finished building.

8 Claims, 3 Drawing Sheets

MODULAR BUILDING CONSTRUCTION

The present invention relates to building structures and to methods of constructing them.

In one particular construction technique known as "pièce en pièce", the area extending between two support columns is spanned by logs stacked vertically on their sides. The tenoned ends of each plank are received within mortices formed in the opposing surfaces of adjacent support columns. Logs of required length are positioned between the columns by sliding the logs downwardly so that a lower edge of a first log abuts the sill timber and subsequent logs stack edgewise on the first log, giving the characteristic pièce en pièce appearance in which the columns are exposed.

While this technique results in a building having a traditional and pleasant appearance, it has certain drawbacks. It is labour intensive, requiring custom-cut logs and a good deal of time and effort to assemble the logs in the desired array. In addition, efforts to complete construction in a specified time can be stalled when it comes to seal the structure against weather. There is a tendency for the logs to slip after positioning and for shrinkage to occur naturally. Thus, until the logs have settled, the plank/column interface cannot be caulked effectively, while the interior partitions, cupboards, panels and the like cannot be rigidly attached to the structure.

It is accordingly an objct of the present invention to obviate or mitigate these disadvantages, by providing a novel building structure and technique for constructing the same.

Briefly stated, the present invention involves a building module for connection between opposed faces of adjacent support columns of a structural building frame, the module comprising a frame having two uprights for connection to the opposed faces and a panel connected to the uprights, such that the uprights define marginal edges of the module.

According to a preferred embodiment, the uprights are attached first to the panel so that they depend from the panel, thereby forming a building module. This module may then be attached to opposing column faces readily on site, reducing construction time. The uprights may be connected by stabilizing cross-members to form a framework to which the panel is attached.

Thus, another aspect of the invention resides in a building module for attachment to opposing faces of adjacent columns of a structural building frame, the module comprising two uprights, one for connection to each of said opposed faces and a panel connected to said uprights such that the uprights define marginal edges of the module.

In yet another aspect of the present invention, there is provided the module a method of erecting a wall area on a building structural frame having adjacent support columns defining opposed faces so as to leave an external face of said columns exposed, the method comprising attaching a frame comprising two uprights so that one of said uprights is attached to one of said opposed faces and attaching a panel to said uprights, the panel being co-extensive with the area of the wall to be covered.

Because the uprights define the marginal edges, the module may be accommodated between the columns and nailed to the columns without interference from any panel overhang. It will be apparent, therefore, that the panel and the upright may co-define marginal edges of the module. This arrangement is preferred.

In another preferred embodiment, the panel is comprised of planks stacked vertically on their edges to reproduce the "pièce en pièce" appearance.

The modules of the present invention offer the advantage that they may be preassembled and brought to the site as and when required. This reduces the time required on site to complete the construction, contributing to cost effectiveness. Where the panel is represented by vertically stacked planks in the pièce en pièce fashion, additional, specific advantages are realized. Whereas slippage and shrinkage is otherwise normally encountered, the module of the present invention allows only minimal slippage and shrinkage since each plank is rigidly connected between the two uprights and each upright is, in turn, rigidly connected to a support column. Sealing around the module can thus be performed without undue delay i.e. without waiting for settling of the planks, which would otherwise be necessary.

Once the uprights and panel are attached and caulked, the area behind the panel may be insulated and covered using any desired cladding. The cladding is most preferably attached to the module through the uprights although it may be attached to the columns, if desired.

A third aspect of the present invention resides in the building erected using the modules. These buildings are as pleasing in appearance and quality as those constructed by the previously described, known methods yet they are more cost attractive.

Embodiments of the invention are hereinafter described by way of example only with reference to the accompanying drawings in which.

Figure 1:
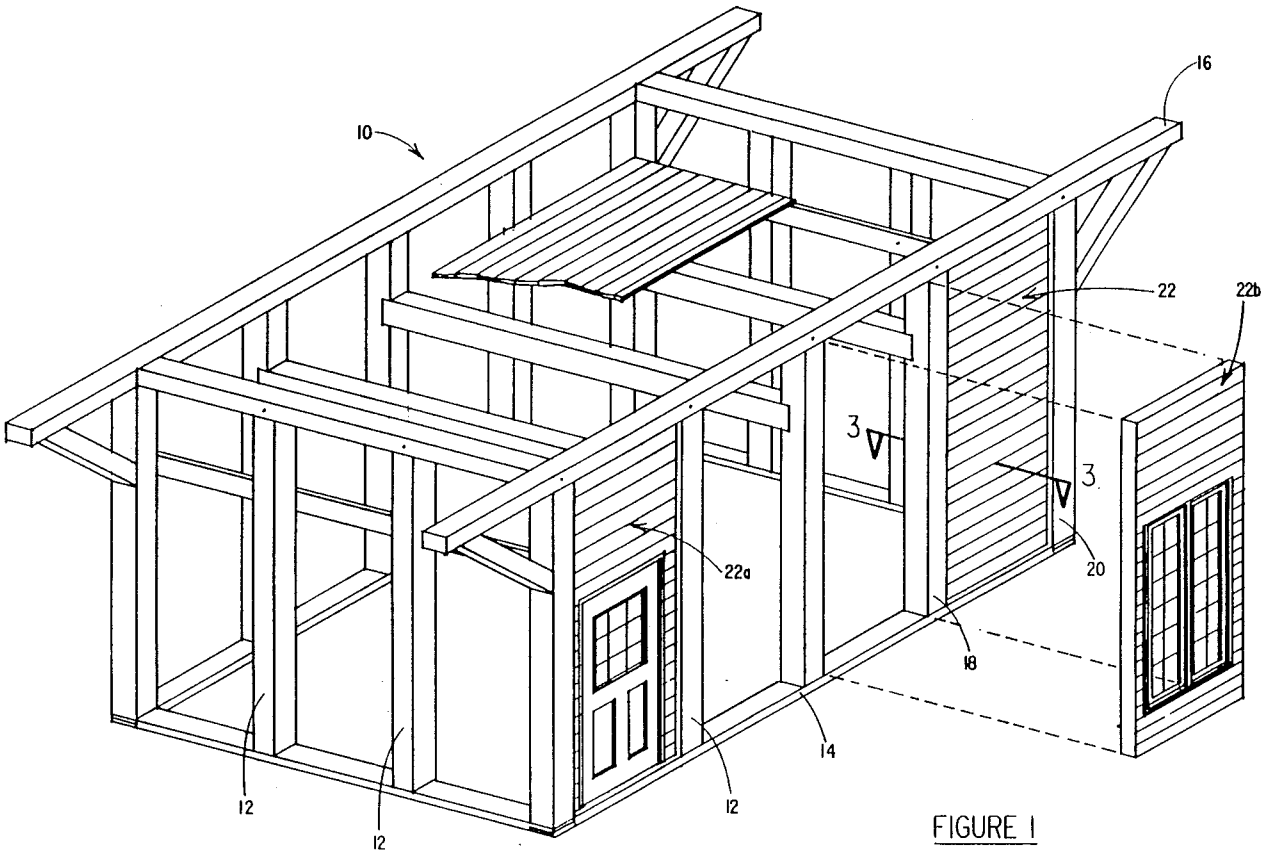
FIG. 1 represents a perspective view of a building partially constructed using building modules.

The structural framework 10 of a building is shown in FIG. 1. The framework includes a plurality of support columns 12 extending between sill beams 14, and wall plate beams 16. In the area between adjacent support columns 18 and 20 is a module 22 which extends between the floor and beams.

Figure 2:
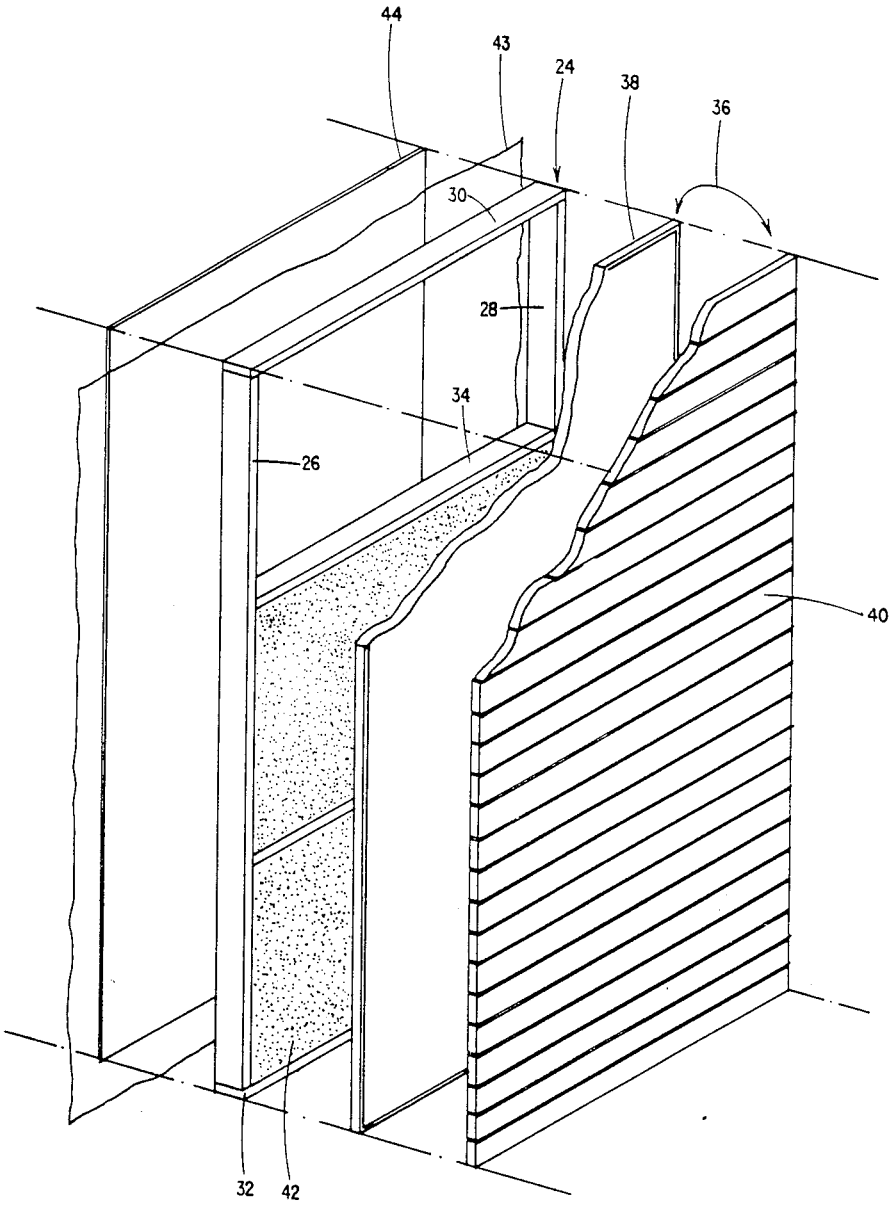
FIG. 2 represents an exploded view of a module.

Module 22 is shown in isolation in FIG. 2. The module has a framework 24 formed from 2"×4" studs, including uprights 26, 28, top member 30 and bottom member 32. Cross-members 34 are incorporated for stability. To the framework is connected a panel 36 having an inner sheet of material 38 acting as a weather barrier and an outer array of planks 40 which reproduce the pièce en pièce appearance. The area defined by the framework 24 is filled with insulating material 42. Attached to the inner surface of the framework 24 is a vapour barrier sheet 43, to which is connected a layer of interior cladding 44. Cladding 44 is presented to the interior of the dwelling and may be painted or embellished in any manner desired by the dweller of the completed building.

Figure 3:
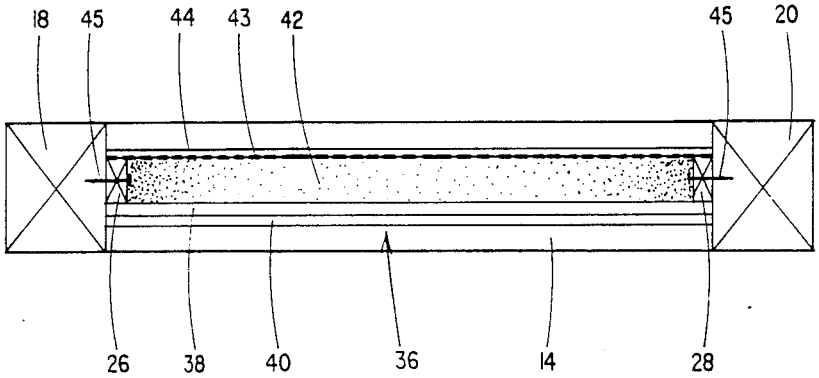
FIG. 3 represents a sectional view taken on line 3-3 of FIG. 1.

In order for the module to be accommodated between adjacent support columns, the marginal edges of the module are defined by the framework 24 as shown in FIG. 3. In the embodiment depicted in FIG. 3, the marginal edges of the panel 36 are coextensive with the perimeter of the framework, as well.

In addition, the inner and outer peripheries of the support columns 18, 20 extend beyond the peripheries of the interior cladding 44 and the planks 40 so as to accentuate the pièce en pièce appearance.

In order to form the module, each of the panel 36, cladding 44 and framework 24 may be cut or formed independently to desired specifications and connected to the framework. Alternatively, the framework may first be formed and used as a guide to trim the panel, once connected. This latter technique may be useful particularly when the planks form the exterior surface of the module to ensure that there is no plank overhanging the framework. In this way, the module can be accommodated snugly between opposed faces of two adjacent columns by abutment between the columns and the framework.

To connect the module in position, nails 43 are hammered through the framework into the column and into the sill and plate beams when the module extends thereto. To allow for this nailing, it will be appreciated that the insulating material and internal cladding are absent and are added only once the module is securely connected. Because the framework depends from the panel, ample room is provided within the confines of the module for the swinging of a hammer to effect the nailing. As an alternative, the framework may be connected first and the panel then nailed to the framework to allow more freedom for nailing. However, prior connection of the panel to the framework is greatly preferred, thereby to reduce the construction time required on site.

After the framework and panel are secured, the framework/column interface may be sealed by the use of caulking foam or other suitable material, almost instantaneously since it is so rigidly positioned and slippage and shrinkage are almost negligible. After sealing, insulation is added and the interior cladding is connected. Interior cladding may be connected directly to the framework, as shown in FIG. 3 or connected to the support columns, if desired.

In wall areas where windows and/or doors are to be positioned, the modules such as those identified as **22*a* and 22*b* in FIG. 1** are designed to accommodate them on a sub-frame attached to the panel and connected with the framework for stability. Despite the existence of the sub-frame, adequate space is provided for the nailing action required to fix the module in position.

To accelerate the construction process, the column posts may be spaced at constant distances so that a number of modules of the same size can be prefabricated for future use. There may, however, be two or more distances which are selected to be constant so that two or more panel sizes may be required. Several variations of the framework 10 are contemplated including the provision of rigid insulation in place of the weather barrier 38.

The embodiments of the invention in which an exclusive property or privilege is claimed are defined as follows:

1. A building having a structural framework consisting of exposed adjacent support columns connected between sill beams and plate beams, wherein said adjacent support columns define opposed faces, a building module connected to the opposed faces of said support columns, the module comprising a frame having two uprights, one connected to each of said opposed faces and a panel connected to said uprights, said panel formed from a plurality of stacked planks whereby when said panel is assembled between said exposed faces, said support columns remain exposed.

2. The building according to claim 1 wherein the module frame is co-extensive with the perimeter of the panel.

3. A building according to claim 2 wherein the module is co-extensive with the region defined within adjacent support columns and the sill and plate beams.

4. The building according to claim 3 wherein the module contains insulating material.

5. The building according to claim 4 wherein the module bears interior cladding enclosing the insulation within the module.

6. The building according to claim 5 wherein the planks are stacked in a horizontal orientation to provide a pièce en pièce appearance.

7. The building according to claim 6 wherein the panel includes a layer of weather barrier material.

8. The building according to claim 6 wherein the panel includes a layer of rigid insulating material.

* * * * *

UNITED STATES PATENT AND TRADEMARK OFFICE

CERTIFICATE OF CORRECTION

PATENT NO. : 4,869,036

DATED : Sept. 26, 1989

INVENTOR(S) : Charles M. Peacock

It is certified that error appears in the above-identified patent and that said Letters Patent is hereby corrected as shown below:

On the title page:
Item [73], change "Building With Legs, Ltd., Canada" to read:

-- Building With Logs, Ltd., Canada --

Signed and Sealed this

Sixteenth Day of October, 1990

*Attest:*

*Attesting Officer*

HARRY F. MANBECK, JR.

*Commissioner of Patents and Trademarks*